United States Patent [19]

Scheffel

[11] 3,938,561

[45] Feb. 17, 1976

[54] DEVICE FOR DRAWING OFF WEFT THREAD

[76] Inventor: Walter Scheffel, Industriestrasse 53, Weissenburg, Bavaria, Germany

[22] Filed: Aug. 31, 1973

[21] Appl. No.: 393,402

Related U.S. Application Data

[62] Division of Ser. No. 200,955, Nov. 22, 1971, abandoned.

[30] Foreign Application Priority Data

Apr. 10, 1971 Germany ..... 2117705

[52] U.S. Cl. ..... 139/122 H; 139/127 P

[51] Int. Cl.[2] ..... D03D 47/36; D03D 47/28

[58] Field of Search ..... 139/122 R, 122 H, 127 R, 139/127 P, 194, 12; 226/97, 113, 117, 118

[56] References Cited

UNITED STATES PATENTS

| | | | |
|---|---|---|---|
| 3,460,584 | 8/1969 | Mosher | 139/124 A |
| 3,580,444 | 5/1971 | Mullekom | 139/122 H |
| 3,693,668 | 9/1972 | Suaty | 139/127 P |

FOREIGN PATENTS OR APPLICATIONS

| | | | |
|---|---|---|---|
| 81,068 | 4/1971 | Germany | 139/12 |
| 2,016,184 | 10/1971 | Germany | 139/122 R |

*Primary Examiner*—Henry S. Jaudon
*Attorney, Agent, or Firm*—Holman & Stern

[57] ABSTRACT

A loom provided with a supply bobbin from which a weft thread can be drawn in which between the supply bobbin and a fluid pressure means for inserting the weft thread in a shed, there is located means for forming a loop of variable size for storage purposes. The loop-forming means is provided with a guide track which extends substantially transversely of a theoretical rectilinear weft thread track between the supply bobbin and the weft thread inserting means, and a guide member operably related to the guide track and being movable to and fro on the guide track and transversely of the theoretical rectilinear track away from the rectilinear track for guiding the weft thread and movable back again, with the guide track being arranged so that the return movement of the guide member is also transversely of the theoretical rectilinear track so that the weft thread is guided during the return movement from the guide member.

3 Claims, 3 Drawing Figures

DEVICE FOR DRAWING OFF WEFT THREAD

BACKGROUND OF THE INVENTION

This application is a division of copending application Ser. No. 200,955 filed Nov. 22, 1971 now abandoned.

The invention is applicable to a loom, equipped with a weft thread feeding means, in which the weft thread is drawn off a storage bobbin, with the object of so storing the weft, that the weft is deflected from its rectilinear course, thereby forming a loop of variable size.

PRIOR ART

In a known apparatus of this type, the weft thread is blown, prior to a pick, into a cylinder closed on one of its sides with a loop thereby being formed in the weft thread. The cylinder is located between a stationary storage bobbin and a thread brake. While a pick is being produced, the loop is drawn out of the cylinder and is stretched. The presence of the loop ensures that the weft thread does not have to be completely drawn from the storage bobbin when a pick is being produced, as a store of weft threads is thereby made available to the pick. When a weft thread has been inserted, the thread brake is closed, thereby determining the length of the weft thread inserted into the shed. When the length of the warp threads are thus determined by means of a thread brake, this represents a drawback since it is only possible to achieve a relatively low accuracy with respect to the lengths of these weft threads. The reason for this is the differing extent to which slip of the weft thread occurs.

The known apparatus does not permit one specific type of weft thread to be stored, from a number of storage bobbins and has the further disadvantage that, due to the fact the storage takes place pneumatically, the weft thread from which the loop is formed is not guided during the process of storing the weft and of removing the weft from the storage. The result thereof is that, in yarn having a high degree of twist, the two parts of a loop may become twisted together, with consequent crimping and formation of snarls. During the insertion of a weft thread into a shed, formed on a loom, it is not possible to remove crimping and kinks in the thread which results in defective woven fabrics being obtained or, alternatively, it may even be impossible to insert the weft.

OBJECTS AND SUMMARY OF THE INVENTION

It is an object of the present invention to provide a weft thread feed device of the type described which enables the weft thread which is to be stored to be given improved guidance.

It is proposed, according to the present invention, to provide a weft thread feed device of the type set forth in which a deflecting or quiding member is provided, preferably located downstream of a thread draw-off roller, which continuously rotates for drawing off weft thread, and over which the weft thread is guided, with the deflecting or guiding member being defined by a roller capable of movement back and forth along a guide path extending transversely of the rectilinear path of movement of the weft thread.

A brake for controlling the length of the weft thread can be eliminated due to the positive mode of guidance of the deflecting member and the loop formed in the weft thread. The advantage of eliminating a brake thread is combined with the further advantage that the length of the weft thread can be accurately controlled. There is only a relatively small tendency to the formation of knots and locally thickened portions, for example, in the case of fancy ply yarns, etc.

Further advantages reside in the simple construction of the feeding device, in its operational reliability, and the elimination of wear caused by friction resulting upon braking the thread.

The weft draw-off roller, the speed of which is preferably steplessly adjustable, continuously draws off thread from the storage bobbin. The speed at which the thread is drawn off is considerably lower than the speed at which the weft thread is inserted into the shed for making a pick. The thread drawn off prior to making a pick, is employed for forming the loop, with the deflecting or guiding member being deflected from the theoretical line of the rectilinenar course of movement of the weft thread. While a pick is being made, the deflecting or guiding member is moved back, so that both weft threads which are already stored and thread which is drawn off while a pick is being made, are available for insertion into the shed.

The insertion of the weft thread into a shed takes place, for instance, by means of grippers, although it preferably takes place pneumatically with means known per se. The free end of the weft thread moves through the shed following the movement of the deflecting or guiding member. Thus, the deflecting or guiding member guides the weft thread both while the weft thread is being stored and also while the weft thread is being removed from the storage. It is possible to eliminate the use of the thread brake, because the speed of movement of the deflecting member can be so controlled, during storage of the weft thread, that the amount of thread stored does not exceed the amount of weft thread drawn off from the storage bobbin.

The guide track may be defined as, for example, a track along which the deflecting member can move back and forth. Preferably, the guide track is defined by a continuously rotating endless chain, laterally stretched on one of its longitudinal sides, since a continuously rotating part is preferred to a part which merely executes reciprocating movement.

A particularly satisfactory embodiment of the invention is if the chain is guided so as to describe curves, caused by the passage of the chain around guide rollers which are located between two rollers provided for guiding the endless chain and on the side of the chain lying closer to the warp thread present in the loom. In this way, it is possible to vary the speed at which the deflecting member is moved back and hence the speed of the weft thread in the shed while a pick is being made through the shed. In other words, the weft thread can, in this fashion, be given variable speeds, according to particular requirements, while a pick is being made.

There is further provided a color changing device, known per se, between a group of storage bobbins and the guide track, with the color changing device serving to feed a selected weft thread to the deflecting member. In this case, a thread clamp is also provided for each weft thread and is positioned upstream or in front of the color changing device. By virtue thereof, it is possible alternately to insert weft thread of different color or type so that the type of weft thread used for each pick can be determined in advance, and can be stored with a high degree of accuracy of control over its length, with these weft threads then being individually inserted into the warp thread on the loom subsequent to storage.

Conveniently, a weft insertion nozzle is provided for each weft thread, with each nozzle having an associated fluid infeed duct which can be closed by a valve, and a thread clamp is provided for each weft thread and is positioned between the nozzle and the guide track. The insertion of the weft threads takes place by means of a fluid and in a manner known per se, for example, a gas (air) or a liquid (water) may be used for this end.

It is not possible, with known looms, to store a selected color from any one of a number of storage bobbins. It is, however, possible to select a specific color of weft thread in this manner by employing the present invention, that is to say the positively guided rotatable deflecting or guiding member, while constant lengths of weft thread are maintained.

In one embodiment, use is made of two thread clamps in addition to the deflecting member, which is commonly used for all colors of the weft thread. These components are all positioned along the path of movement of the weft thread. Thread clamps of this type serve to free and grip the weft threads in turn for storing or for insertion into a shed for a pick, with the releasing and gripping actions being effected at specific times during the loom working cycle. In this manner, it is ensured that, with the use of such thread clamps, the thread does not have to be braked when it has been travelling at a high speed. Hence, it is possible to prevent slip of the weft threads, with the frictional wear resulting from such slip. The thread clamps do not affect the length of the loop of weft thread, formed for storage purposes, but control the movement of the weft thread to and from the storage loop, formed by the deflecting or guiding member. The opening and closing of the thread clamps always takes place when the weft thread, which passes through the clamps, has come to a stop. As a consequence, a multi-color device of this type does not have the drawbacks or disadvantage of the decreased accuracy of length of the weft threads, if the weft thread is formed with knots (snarls) or regions of increased or reduced thickness, or if fancy ply yarns are employed as weft thread.

In an apparatus of this type, constructed for the insertion of weft thread of different color, it is also possible to eliminate a continuously rotating weft draw-off roller. In a loom modified in this manner, the weft thread is drawn off in a positively controlled fashion from the particular storage bobbin being used at any given time, with the weft thread being directly drawn off from the storage bobbin by the continuously rotating deflecting member. There is provided, for controlling the colors of the weft threads to be inserted into the successive sheds formed, a color changing device, which may, for example, be constructed in accordance with German patent specifications Nos. 1282567 or 1257695. A color changing device of this type is located between the two thread clamps and upstream of the weft deflecting member.

Synchronously with the control of the individual colors by the so-called color changing apparatus, the two thread clamps which are associated with each weft thread color, are so moved that, at the start of the storage process effected by rotating the weft deflecting member, the thread clamp arranged at the input side is opened, while the thread clamp arranged at the output side is closed by the automatically functioning control connection. In this manner, it is ensured that the weft thread cannot be withdrawn from the weft inserting nozzle. The control of the two thread clamps, which work in opposite directions to each other, and which are together provided for a single weft color, is exercised, for example, by a cam which rotates at the same speed as the weft deflelcting member, and also at the same speed as the loom per se, or the sley, which constitutes part of the loom and which serves to beat up the weft thread. A weft inserting nozzle is provided for each of a number of different colors in which weft thread is stored on the storage bobbins. Each of the nozzles is individually supplied with air when the corresponding color of thread is to be picked, or when the storage loop is to be smoothed out during the insertion of the weft thread into a shed. Air valves are provided to control the air fed to the nozzles and, similar to the thread clamps, are actuated synchronously with the color changing apparatus.

The invention will now be described with more particularity with reference to the accompanying drawings in which:

DETAILED DESCRIPTION OF THE DRAWINGS

Figure 1:
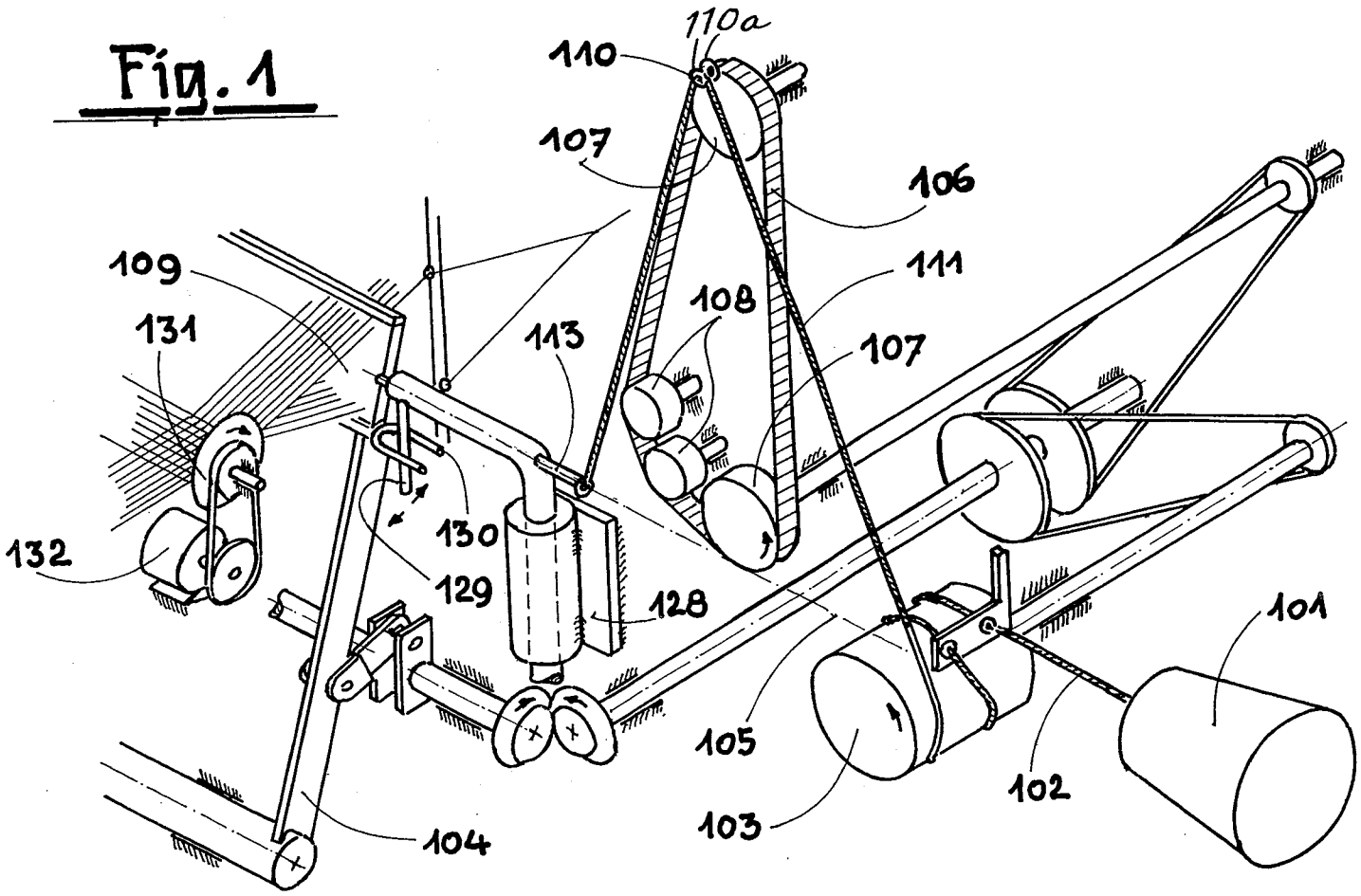
FIG. 1 is a view in perspective, partly broken away, of a weft thread feed device provided with weft draw-off rollers.

Referring to FIG. 1, it will be seen a thread 102 is drawn, by a draw roller 103 and at a constant speed, from a bobbin 101, with the draw roller 103 being driven in a counter-clock-wise direction at a constant speed. The thread 102 is completely coiled around the draw roller 103.

If the thread 102 was not deflected in its travel downstream of the draw roller 103, the thread would describe a rectilinear path of movement in the area located downstream of the roller 103, with such rectilinear path being indicated by a dot-dash line 105.

Also located downstream of the draw roller 103 is an endless chain of flexible belt means 106 which is guided around upper and lower guide rollers 107. A line intersecting the center axis of the guide rollers 107 extends at a right angle to the rectilinear path 105 indicating a theoretical path of movement of the thread. The line intersecting the center axes of the guide rollers 107 could, however, include an angle other than 90° with respect to the line 105. The endless chain 106 is driven by drive means (not shown) and rotates continuously in a counter-clockwise direction.

The chain 106, on its side remote from the draw roller 103, is guided, between the upper and lower rollers 107, over guide rollers 108 so that the chain or flexible belt means 106 departs from a rectilinear path of movement and describes a curved or arcuate path in the zone of the rollers 108. The particular contour of these curves in the path of movement of the chain 106, depends upon the particular arrangement selected for the rollers 108, and upon the particular alterations in speed which the end of the weft thread is to undergo when it is being inserted into a shed 109 produced on the loom.

A deflecting member 110 is arranged on a link of the chain 106 and extends at a right angle to the circulatory path of movement of the chain. The deflecting member 110 is illustrated as a pin carrying flange end pieces 110*a*, with the thread 102 being guided between the flange end pieces. Alternatively, the deflecting member could be defined by a rotating eye from which the thread would not be able to jump. The thread, guided by the deflecting member 110, forms a loop 111, whose size depends, at any given time, on the momentary position of the deflecting member 110. The loop 111 starts at the draw roller 103 and ends at a nozzle 113 from which it is pneumatically inserted into the shed 109.

It should be noted that the weft thread 102 is continuously guided alongside the deflecting member 110 and is never drawn off from the deflecting member. The deflecting member 110 moves upwardly with the weft thread, when there is no insertion into the shed 109, and moves downwardly with the weft thread when there is insertion into the shed.

The draw roller 103 constantly draws the weft thread from the bobbin 101, even when there is no insertion into the shed. The deflecting member 110 can, therefore, move upwardly without the free end of the weft thread being drawn out of a nozzle 113.

Figure 2:
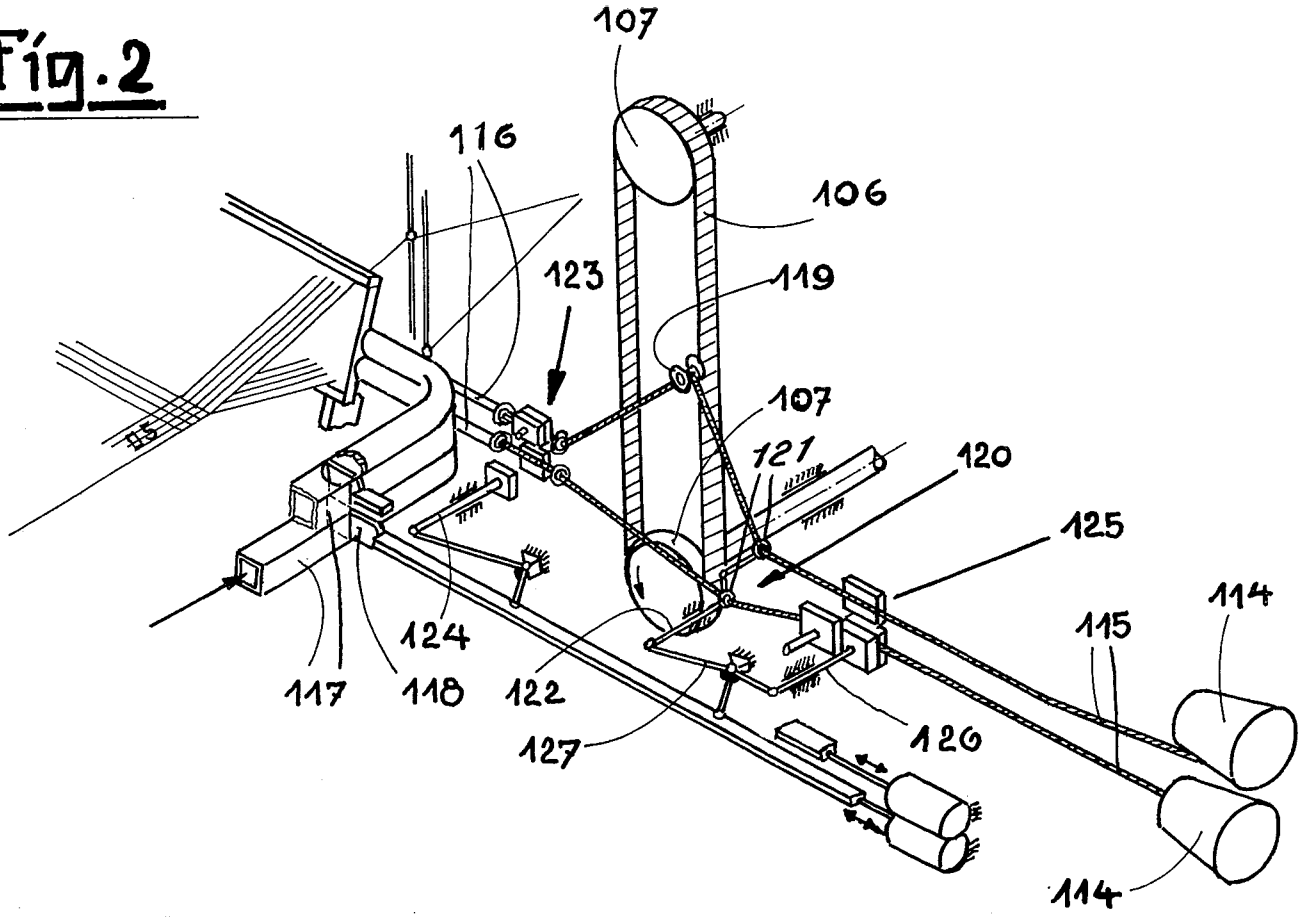
FIG. 2 is a perspective view of a weft thread feed device provided with a color changing device, and thread clamp.

As will be apparent from FIG. 2, it is also possible to clamp the free end of the weft thread when the deflecting member moves upwardly and no special draw roller is provided.

Referring to the weft thread feed device shown in FIG. 2, for the sake of simplicity, there is illustrated only two storage bobbins 114.

Of course, the device could be modified to include more than two storage bobbins.

Each weft thread 115 is fed, from two stationary storage bobbins 114, to an associated nozzle 116, by means of which the weft thread can be inserted into a shed. Compressed air can be fed, in a manner known per se, and by way of a feed duct 117, to each nozzle 116, with the compressed air serving to blow a weft thread from the nozzle. A valve 118 is provided for each feed duct 117 and, in one position, allows a passage of air into the nozzle 116, with control of the valve being effected by means of a linkage 127 which can be shifted, for example, by a magnet.

The endless chain 106 is guided over suitable upper and lower rollers 107 and the chain carries a weft thread deflecting member 119. The deflecting member 119 and the chain 106 are so arranged that the deflecting member 119 can pass by a weft thread 115 which is moving rectilinearly from a storage bobbin 114 to a nozzle 116, without entraining the weft thread. The deflecting member 119 is of suitable profiled configuration and can be of the type shown in FIG. 1. The endless chain 106 is driven in such a fashion around one of the rollers 107, that the deflecting member 119 makes one complete circulation, on its associated chain link, for each beaking-up action executed by a sley 104 illustrated in FIG. 1, but not shown in FIG. 2.

A color changing device 120 is located between the storage bobbins 114 and the weft thread deflecting member 119, or the endless chain 106. The device 120 is driven by suitable means (not shown) so that it functions synchronously in step with the sley 104. The color changing device 120 is provided with an eye 121 for each weft thread 115, with an associated one of the weft threads being arranged to be guided through each of the eyes 121. Each eye is fixed to a linkage 122, by means of which the eye can be caused to move back and forth so that the weft thread, guided by the eye, first crosses the path of movement of the deflecting member 119 and on a subsequent movement runs to the outside of the path of movement of the member 119.

A thread clamp 123 is provided for each weft thread and is positioned between the nozzles 116 and the endless chain 106, with the thread clamp incorporating a stationary clamping part and a movable clamping part. The movable clamping part has movement imparted thereto via a linkage 124. A further thread clamp 125 is also provided for each of the weft threads, and is located between the storage bobbins 114 and the eye 121. The further clamp 125 also includes a stationary clamping part and a movable clamping part which can be moved by a linkage 126.

The valves 118 and the clamps 123, 125, are controlled via a linkage 127, 122, 124, and 126 as follows:

The deflecting member 119 is lifted from the vicinity of the lower guide roller 107 and approaches one of the stretched weft threads 115. The color changing device 120 draws the weft thread 115, by means of an eye 121, onto the weft deflecting member 119. As soon as the weft thread has been drawn out into the form of a loop, the clamp 123, located on the side of the nozzles, is closed, and clamp 125, located on the side of the storage bobbin is opened. When the deflecting member 119 has reached the upper guide roller 107, at which point the weft thread has undergone the maximum degree of deflection from its theoretical rectilinear path of movement, the clamp 125 is closed, and the clamp 123, together with the valve 118 associated with the nozzle 116, opened.

The valve 118 is re-closed when the deflecting member 119 has reached the lower roller 107, at which point of time the whole loop of weft thread has been inserted into the shed. The color changing device 120 now pulls the weft thread, which has just been the subject of a pick, away from the path of movement of the deflecting membere 119 and moves the next weft thread into the path of movement of the deflecting member 119.

FIG. 1 illustrates a further feature of the present invention and it can be seen that the nozzle 113 can be pivoted by its front free end about a vertical axis. For this purpose, the nozzle 113 is arranged to be pivotable on a plate 128 and the free front end of the nozzle is guided in a fork 130 via a pin 129. The fork 130 is arranged on the sley 104 and hence the free front end of the nozzle 113 moves together with the sley.

Also a rotating knife 131 is located in the area of the shed 109 at which the inserted weft thread is beaten-up, and the knife is driven by a suitable drive means 132. A weft thread, which has been inserted into the shed 109, can thus be held in the nozzle 113, until it has been beaten-up, or in other words, worked into the fabric of the warp threads. The thread is only cut off by the rotating knife 131 after the thread has been beaten-up by the sley 104 so that a weft thread clamping device can be eliminated.

It will be appreciated that the weft thread feed device illustrated in FIG. 1 is distinguished by the feature that the front free end of the nozzle 113, serving to insert weft threads into newly formed sheds, can be moved back and forth, in step with the movements of the sley 104, to and from the area of the shed at which the weft thread is beaten-up against the rear edge of the fabric being woven. In more detail, the front end of the nozzle 113 is moved, in the course of this reciprocating movement, to a theoretical extension, or extension in space, of the point in the shed at which the beating-up action occurs. The knife 131, serving to sever weft threads, also lies at the rear edge of the fabric being woven. Moreover, the nozzle 113 serving to insert the weft thread, is arranged to be pivotable about the vertical axis at one of its ends, while at its other end, it is attached to the sley 104.

Figure 3:
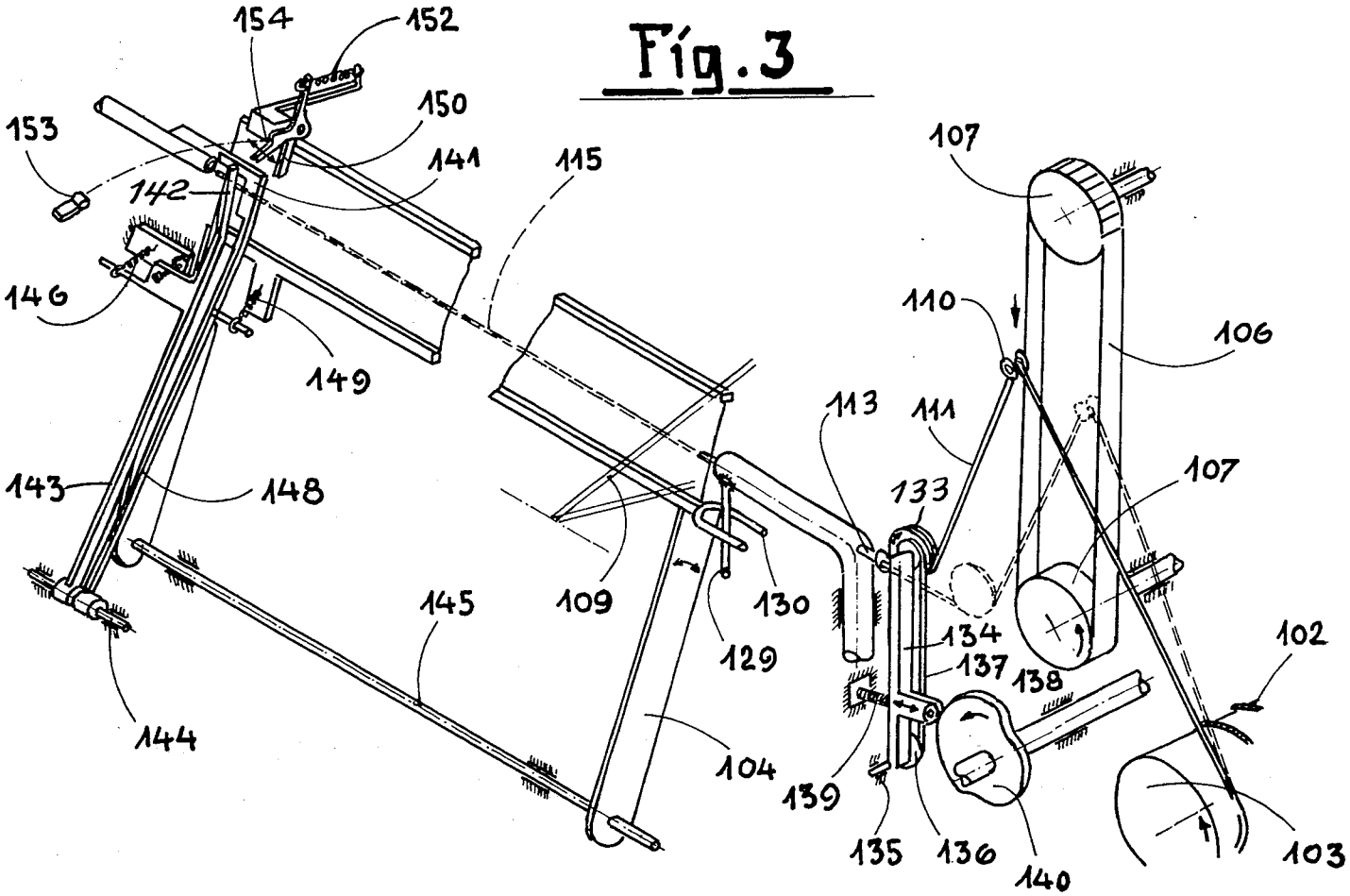
FIG. 3 is a perspective view of a weft thread feed device provided with a device for clamping the weft thread.

In FIG. 3, a thread 102 is drawn off from a bobbin (not shown) at a constant speed by means of a draw roller 103. An endless chain 106 is positioned downstream of the draw roller 103 and is guided by upper and lower guide rollers 107. A weft deflecting member 110 is fixed to one link of the chain 106 and the weft thread, guided over the deflecting member 110, forms a loop 111 which ends at a nozzle 113. The drive of the chain 106 is such that the deflecting member 110 executes one complete revolution for each beating-up action performed by the sley 104. A yoke or fork 130 is arranged on the sley and a pin carried by the front free end of the nozzle 113 is guided within the fork. For other details of components of this particular embodiment, attention is called to the detailed description of FIG. 1.

A guide roller 133 is pivotally mounted, in front of the nozzle 113, at the upper end of an arm 134, and the lower end of the arm is pivotable on a pin 135 which also carries a roller 136. The roller 136 is capable of being driven, so that the roller 136 can drive, via an endless belt 137, the guide roller 133 over which the weft thread is guided. A roller 138 is located on an extension of the arm 134, and is held, by means of a spring 139 against the periphery of a cam 140 which is rotated in step with the working movements of the loom as a whole.

A plate shaped anvil 141 is positioned on the side of the sley 104 opposite to the nozzle 113, with the anvil being mounted on a swivel arm 148 in the upper portion of the sley. More specifically, it is mounted in the vicinity of the reed. The anvil 141 lies in the path of movement of the weft and an elongate hammer 142 is provided opposite the anvil 141. The hammer 142 lies in the upper portion of a swivel arm 143 which is rotatable at its lower portion about an axis 144 which lies in front of pivot axis 145 of the sley 104. The swivel arm 148 is also pivotable about the axis 145.

The hammer 142 is held together with the swivel arm 143 by means of a spring 146 against a stationary stop 147. The anvil 141, together with the swivel arm 148, is connected to the sley 104 by means of a spring 149, with the anvil being held by such spring so that it is shiftable in the upper reed of the sley. A downwardly extending cutter 150 is positioned stationarily on the reed and can swivel relative to a further cutter 151. The cutter 151 is held in its open position by a spring 152 engaging the sley 104, and closes when it comes into contact with a stationary stop 153.

A suction tube 154 is positioned to the rear of the hammer 142 and anvil 141. The hammer 142 and the anvil 141 together constitute a weft thread clamp, in conjunction with components provided for their actuation. The blades 151, 150 constitute a thread severing device.

The roller 133 rotates, during operation, about its own axis and swivels about the shaft 135. The suction tube 154 grips the weft thread, after the weft thread has been inserted into the shed 109 and thus tensions the weft thread. The weft thread is then securely gripped by the anvil 141 and the hammer 142. The roller 133 then tensions the weft thread and a beating-up action is performed by the sley 104, on the weft thread which has thus been inserted into the shed. The severing device 150, 151 cuts the weft thread between the edge of the fabric being woven and the clamp, after the weft thead has been beaten-up by the sley. When the clamp is again opened, the severed weft thread end is removed from the suction tube 154.

The roller 133 lies at a point at which the weft thread is deflected by an angle of about 90° and performs a rocking motion either in the direction of the arrival of the thread or in the direction of departure of the thread from the roller 133. As is clear in FIG. 3, the roller 133 rocks in the direction in which the weft thread leaves the roller 133 and the roller 133 is driven so that its circumferential speed amounts, at its maximum value, to the speed of the weft thread. The thread clamp is moved and actuated by the sley 104 and has an axis of rotation such that it is moved, relative to the sley, in the direction of the weft thread severing means 150, 151, with the result that the thread is carried by the clamp into the severing means. The severing means is positioned on the reed and is closed by the stationary stop 153.

What is claimed is:

1. In a loom provided with weft thread supply bobbin means for weft thread and a warp shed into which constant lengths of weft thread are to be inserted, continuously operated draw roller means for drawing the weft thread from the supply bobbin means, fluid-pressure, weft inserting means for fluid-expressing and inserting weft thread in the warp shed, said draw roller means and said fluid-pressure weft inserting means defining a rectilinear path of travel therebetween, and continuously-operated weft thread deflecting means located between said draw roller means and weft thread inserting means continuously forming a weft loop of variable size for storage and supply purposes, said weft thread deflecting means including endless belt means having a path of travel movable substantially transversely from and beyond the rectilinear weft thread path of travel between the continuously operated draw roller means and the weft thread inserting means, a deflecting member on the endless belt means movable therewith and engaging with the weft thread during movement of the endless belt means both toward and away from the rectilinear path of travel of said weft thread thereby positively controlling the variable size weft thread loop during both formation of the loop and insertion of the weft thread into the warp shed.

2. In the loom as claimed in claim 1 in which the draw roller means and endless belt means are movable in the same direction.

3. In the loom as claimed in claim 2, in which said endless belt means comprises link members and includes upper and lower guide rollers, further guide rollers located laterally of the lower guide roller in the side thereof remote from the draw roller means, and said link members trained about said guide and further guide rollers, with the link members following a rectilinear path between the upper and lower guide rollers on the side adjacent the draw roller means and a curvilinear path on the side remote from the draw roller means.

* * * * *